US009782009B2

(12) United States Patent
Backer et al.

(10) Patent No.: US 9,782,009 B2
(45) Date of Patent: Oct. 10, 2017

(54) BODY SUPPORT BRIDGE

(71) Applicants: Bruce Everett Backer, San Diego, CA (US); Mona Dehshid, San Diego, CA (US)

(72) Inventors: Bruce Everett Backer, San Diego, CA (US); Mona Dehshid, San Diego, CA (US)

( * ) Notice: Subject to any disclaimer, the term of this patent is extended or adjusted under 35 U.S.C. 154(b) by 148 days.

(21) Appl. No.: 14/634,466

(22) Filed: Feb. 27, 2015

(65) Prior Publication Data

US 2015/0238018 A1 Aug. 27, 2015

Related U.S. Application Data

(60) Provisional application No. 61/945,626, filed on Feb. 27, 2014.

(51) Int. Cl.

| | |
|---|---|
| ***A47C 7/42*** | (2006.01) |
| ***A47C 7/46*** | (2006.01) |
| ***A47C 7/02*** | (2006.01) |
| ***A47C 16/00*** | (2006.01) |
| ***A47C 16/02*** | (2006.01) |

(52) U.S. Cl.

CPC ..... *A47C 7/425* (2013.01); *A47C 7/021* (2013.01); *A47C 7/46* (2013.01); *A47C 16/00* (2013.01); *A47C 16/025* (2013.01)

(58) Field of Classification Search

CPC .. A47C 7/62; A47C 7/52; A47C 7/185; A47C 7/425; A47C 7/506; A47C 16/025; A47C 16/00; A47C 7/46; A47C 7/021; A47B 23/043

See application file for complete search history.

(56) References Cited

U.S. PATENT DOCUMENTS

| | | | | |
|---|---|---|---|---|
| 2,663,029 | A * | 12/1953 | Whitley | A47C 20/027 297/377 |
| 2,726,835 | A * | 12/1955 | Hummel | A47F 5/112 211/73 |
| 6,158,813 | A * | 12/2000 | Karash | A47C 5/005 297/391 |
| 2010/0155346 | A1* | 6/2010 | Cheng | A47B 23/043 211/13.1 |
| 2011/0233977 | A1* | 9/2011 | Ku | A47C 7/383 297/230.13 |

(Continued)

FOREIGN PATENT DOCUMENTS

| | | | | |
|---|---|---|---|---|
| EP | 0086274 | A1 * | 8/1983 | A63B 5/08 |

*Primary Examiner* — Nicholas Polito
*Assistant Examiner* — Myles Throop
(74) *Attorney, Agent, or Firm* — Gary L. Eastman, Esq.; Eastman & McCartney LLP

(57) ABSTRACT

A body support bridge comprising a four panel hinged device with top plate capable of adjustable flexed mounting into a generally arched shape from a folded flat configuration. A top plate and front plate are covered with foam. A hinged adjustment plate engaged against adjustment tabs lifts and flexes the top plate into at least four different height levels for multiple functions, including lumbar support positioned between a user's back and the seat, thigh support positioned on a seat behind a user's knee, a foot rest with the device placed on the floor, and a head rest positioned with the front plate placed on a tray table.

15 Claims, 4 Drawing Sheets

(56) References Cited

U.S. PATENT DOCUMENTS

| | | | | |
|---|---|---|---|---|
| 2012/0037047 | A1* | 2/2012 | Moldovan | A47B 23/043 108/3 |
| 2013/0276236 | A1* | 10/2013 | Rasmussen | A47G 9/1027 5/640 |
| 2014/0183323 | A1* | 7/2014 | Sheldon | A47B 23/043 248/455 |

* cited by examiner

BODY SUPPORT BRIDGE

RELATED APPLICATIONS

This application is a conversion of, and claims the benefit of priority to, the U.S. Provisional Patent Application for "Body Support Bridge," Ser. No. 61/945,626, filed on Feb. 27, 2014.

FIELD OF THE INVENTION

This invention relates generally to body support devices, and more particularly to a four panel hinged expandable structure that provides support for different parts of a body while in a sitting position to enable a traveler to change positions and comfortably sit for extended periods of time.

BACKGROUND OF THE INVENTION

Travelers are required to keep themselves upright in seated cramped positions when in public transport, whether on airplanes, trains or car-based vehicles. Long trips pose particular problems in maintaining the seated position for hours at a time. For example, on a long trip, a traveler may desire to sleep or doze to pass the time more quickly. However, after sitting for long periods, a traveler may position the body in a manner that would cause soreness and stiffness especially in the lower back. The traveler also needs to move frequently to promote blood circulation.

Travelers desire to carry few articles onto public transportation because of the space constraints.

Accordingly, there is an as of yet unmet need in the travel industry for a compact, portable device that allows a traveler to provide support for back, thighs, feet and head while facilitating good circulation while in a seated position for hours at a time.

SUMMARY OF THE INVENTION

The inventive Body Support Bridge of this application comprises four primary structural components: 1) a top plate with engineered thicknesses to flex at controlled amounts along a length to support a load; 2) a front plate that hinges to both the top plate and a base plate; 3) a base plate fitted with a suitable ridged material (wood or aluminum) which hinges to both the top plate and the front plate; and, 4) an internal adjustment plate that hinges at the intersection of the front plate and base plate. As the adjustment plate is lifted within the hinged plates, it levers (flexes) the top plate outward and is then engaged under compression forces against adjustment tabs for a desired height.

The top plate further includes molded-in adjustment tabs which engage the adjustment plate, hinges to attach to the base plate and front plate, and a recessed magnet to engage a second magnet recessed in the ridged base plate. The base plate further includes a recessed magnet corresponding to the magnet in the top plate.

The top plate and front plate are covered with either laminated or removable foam. The foam is covered with either a disposable or washable material.

When opened, the support device has four levels of height adjustment and four primary functions: 1) as a lumbar support, it is positioned between a user's back and the seat with a crown of the arc at belt height; 2) as a thigh support, the device is positioned on a seat with the crown of the arc behind the user's knees; 3) as a foot rest, the device is placed on the floor with the top plate facing the floor creating a rocker for the foot; and, 4) as a head rest, the device may be positioned with the front plate down on a tray table with the top plate facing the user.

BRIEF DESCRIPTION OF THE DRAWINGS

The invention is described in more detail with reference to the attached drawings, in which.

DETAILED DESCRIPTION OF THE ILLUSTRATIVE EMBODIMENT

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention.

In this regard, the invention is illustrated in the several diagrams and photographs, and is of sufficient complexity that the many parts, interrelationships, and sub-combinations thereof simply cannot be fully illustrated in a single patent-type drawing. For clarity and conciseness, several of the figures show in schematic, or omit, parts that are not essential in that diagram to a description of a particular feature, aspect or principle of the invention being disclosed. Thus, the best mode embodiment of one feature may be shown in one figure, and the best mode of another feature will be called out in another figure.

Body Support Bridge

Figure 1:
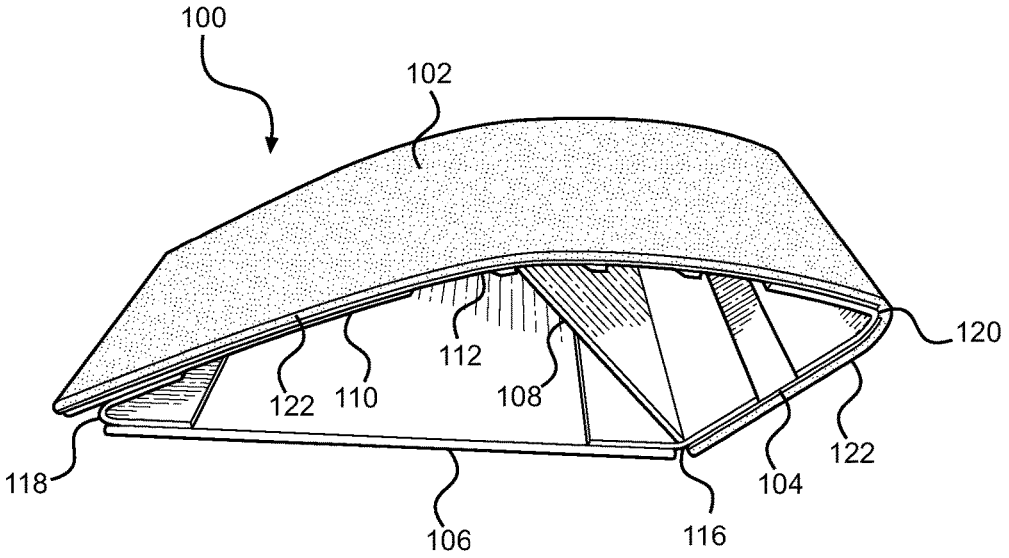
FIG. 1 is a side view photograph of the inventive body support bridge in an open, flexed position, according to the invention.

FIG. 1 is a side view figure of the inventive body support bridge 100 in an open, flexed position, according to the invention. As shown in FIG. 1, the Body Support Bridge 100 is comprised of four primary structural components. A flex plate 102 is constructed with engineered thicknesses to flex at controlled amounts along its length to support a load thereby creating a stiffener section 110 and a flex section 112. Flex plate 102 includes molded-in adjustment tabs 114 (see FIG. 3) which engage the adjustment plate 108. Hinge 118 attaches the flex plate 102 to a base plate 106, hinge 116 connects front plate 104 to base plate 106, and hinge 120 connects a front plate 104 to flex plate 102. Hinges 116, 118, and 120 may be polymeric textile hinges, molded hinge points, or a combination thereof. A recessed magnet 124 (see FIG. 2) engages a second magnet (not shown) recessed in the ridged base plate 106. A front plate 104 hinges to the flex plate 102 and the base plate 106. The base plate 106 is fitted with a suitable ridged material (wood or aluminum) and hinges to the flex plate 102 and front plate 104. The base plate 106 includes a recessed magnet (not shown) corresponding to the magnet 124 in the flex plate 102. Finally, an adjustment plate 108 hinges at the intersection of the front plate 104 and base plate 106. As it hinges, it levers the flex plate 102 outward and engages adjustment tabs 114 (see FIG. 3) at a desired height such that an arc is formed.

Figure 2:
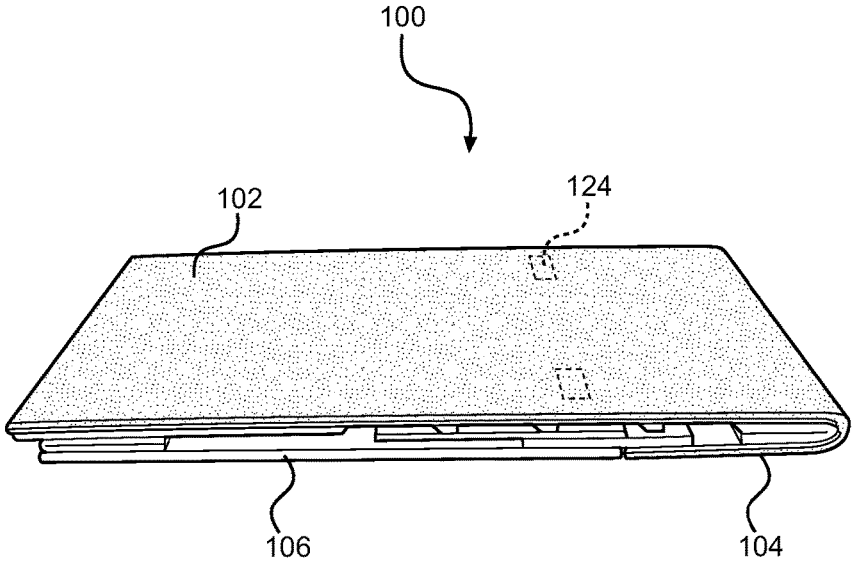
FIG. 2 is a side view photograph of the inventive body support bridge in a closed, flat position, according to the invention.

FIG. 2 shows the body support bridge 100 in a closed, flat position. As shown in FIG. 2, the flex plate 102 length equals the length of the base plate 106 plus the front plate 104, thereby permitting the body support bridge 100 to fold flat. The body support bridge 100 is a continuous loop enabling the open positions to be under tension, thereby creating the supporting arc as shown in FIGS. 1 and 3-5. Magnets 124 may be recessed inside the flex plate 102 and base plate 106 to retain the body support bridge 100 in a closed position. The flex plate 102 and front plate 104 are covered with either laminated or removable foam 122 (see FIG. 1). The foam 122 is covered with either a disposable or a washable material.

Figure 3:
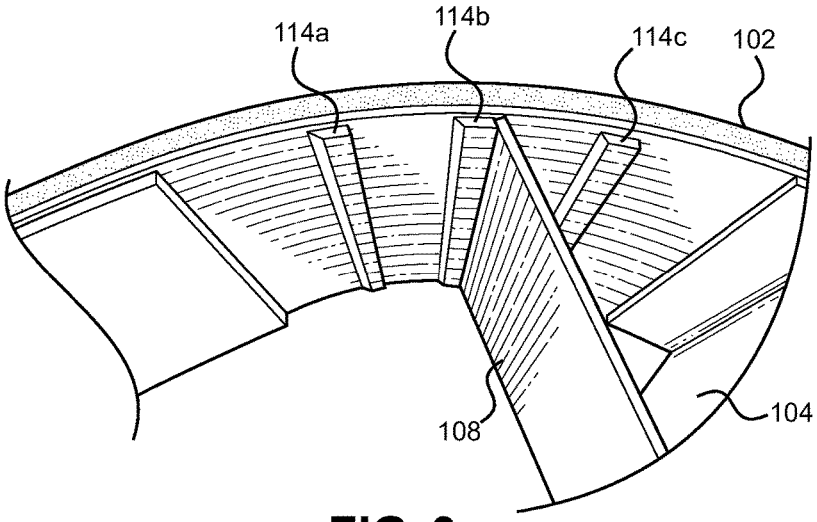
FIG. 3 is a close up photograph of the adjustment tabs spaced along the base surface of the top plate.

FIG. 3 shows the adjustment tabs 114 spaced along the interior surface of the flex plate 102. The adjustment tabs 114 engage the adjustment plate 108 under compression, thereby lifting and flexing the flex plate 102 into an arc shape. As shown in FIG. 3, the interior surface of flex plate 102 has three (3) adjustment tabs, 114*a,b,c*. Placing adjustment plate 108 into adjustment tab 114*a* will result in a smaller arc then if adjustment plate 108 is placed into adjustment tabs 114*b* or 114*c*, and utilizing adjustment tab 114*b* will result in a smaller arc then if adjust plate 108 is placed into adjustment tab 114*c*. It is to be appreciated by someone skilled in the art that the peak of the arc formed when adjustment plate 108 is inserted in adjustment tabs 114*a, b*, and *c* shifts to be centered over the adjustment tab 114 in use. This allows body support bridge 100 *t* be used to support different body positions, as shown in FIG. 5. It is to be further appreciated by someone skilled in the art that any number of adjustment height tabs 114 may be employed without departing from the spirit of the invention.

Figure 4:
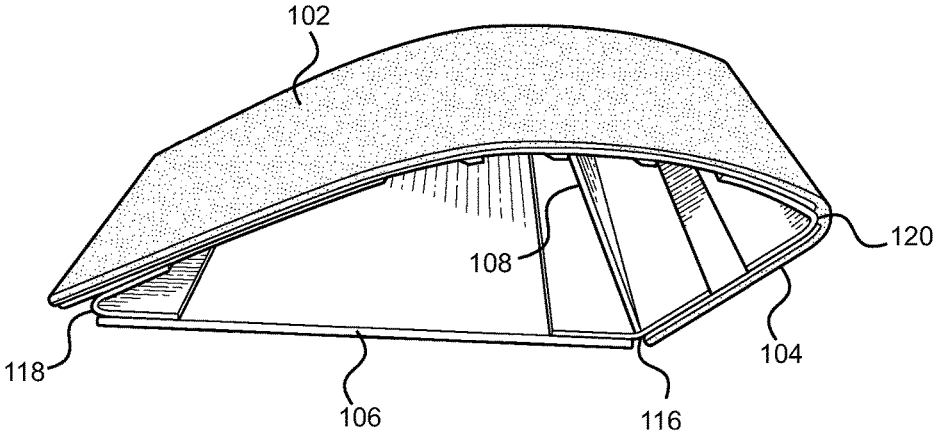
FIG. 4 is a side view photograph of the device in the maximum open, flexed position.

FIG. 4 shows the body support bridge 100 in the mid-level open, flexed position due to adjustment plate 108 being inserted in adjustment tab 114*b*. The tension is created via hinged connections 116, 118, and 120 between the three plates (flex 102, front 104, and base 106) in operative combination with the adjustment plate 108 engaged against the adjustment tabs 114.

Figure 5B:
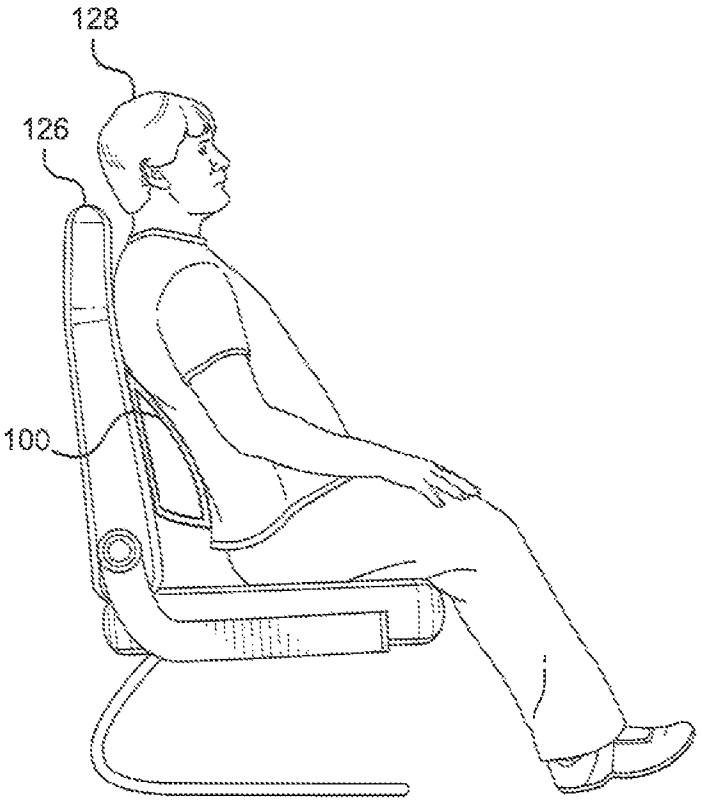
FIG. 5B is a side view of a user sitting in a seat using the device to add lumbar support to the user's back while in the seated position.
Figure 5A:
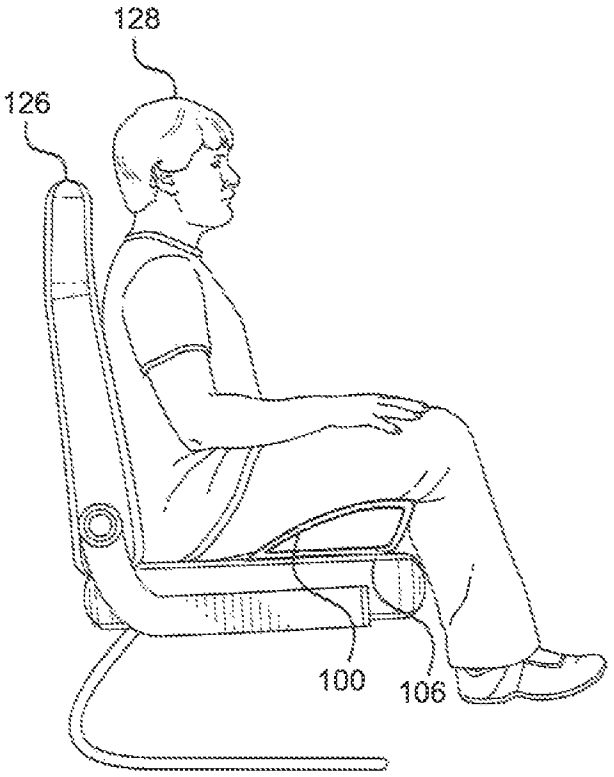
FIG. 5A is a side view drawing of a user sitting in a seat using the device to support the user's legs while in the seated position]
Figure 5C:
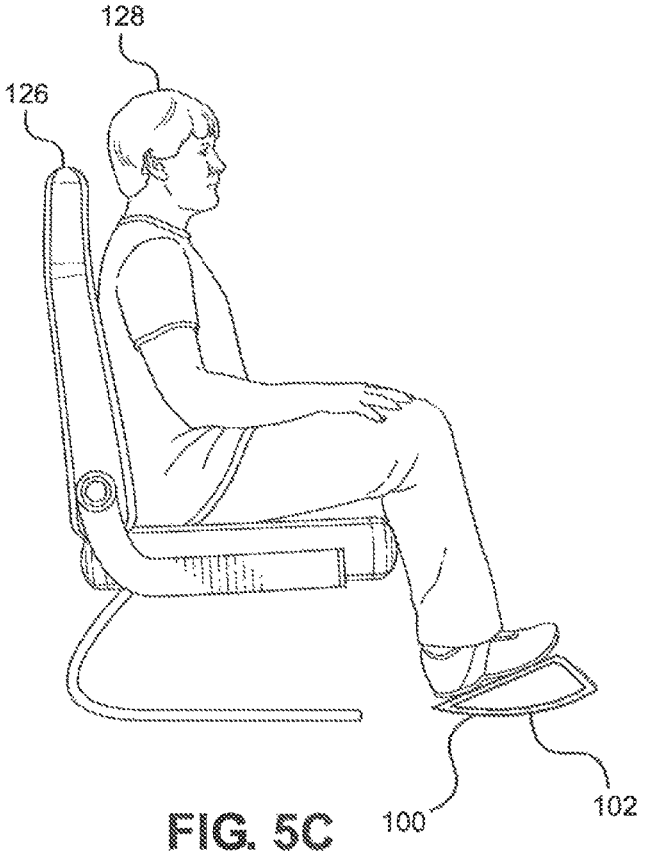
FIG. 5C is a side view of a user sitting in a seat using the device to add foot support to a user while in the seated position.
Figure 5D:
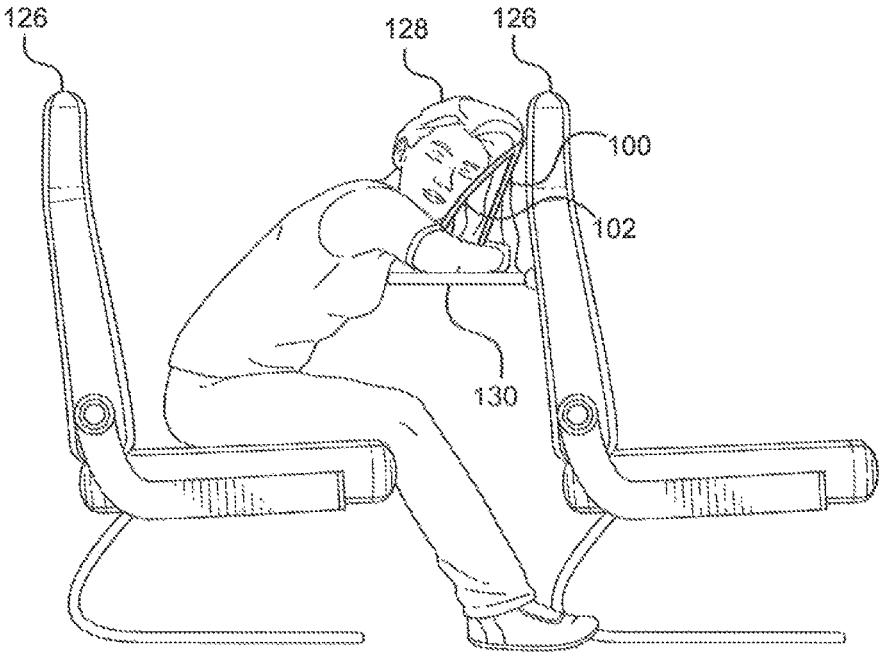
FIG. 5D is a side view of a user leaning forward while sitting in a seat using the device as a pillow.

FIG. 5A thru FIG. 5D show a user 128 sitting in a seat 126 using the body support bridge 100 to support various parts of the body in various seated positions. Referring to FIG. 5A thru FIG. 5D, the body support bridge 100 may be opened and flexed to three different height levels. The height level is selected by the user 128 based on the user's 128 preference and/or body size. Once opened and flexed, the body support bridge may be utilized for four primary comfort functions: (1) As shown in FIG. 5B, a lumbar support is positioned between the user's 128 back and the seat 126 with the crown of the arc at belt height of the user 128. (2) As shown in FIG. 5A, a thigh support is positioned on the seat 126 with the end of the arc behind the user's 128 knee(s). The ridged base plate 106 allows the body support bridge 100 to extend beyond the front edge of the seat 126. Raising the user's 128 knee above their hips is a soothing position to stretch the leg after sitting for long periods. For maximum benefit, a user 128 may alternate the body support bridge 100 from one leg to the other. (3) As shown in FIG. 5C, body support bridge 100 is used as a foot rest when placed on the floor with the flex 102 plate down creating a rocker for the user's 128 foot or feet. It can also be used with the curved flex plate 102 up for a static support. For maximum benefit, it is intended to alternate the device from one foot to the other. (4) As shown in FIG. 5D, body support bridge 100 is utilized as a head rest when positioned with the front plate 104 (not shown) down on the tray table 130 with the flex plate 102 facing the user 128. This provides a raised surface to put a pillow and rest your head in a forward leaning position. On long journeys, a user 128 may prefer this position to promote comfortable sleeping.

Secondary uses for the body support bridge 100 include: (1) As a reading accessory, the base plate 106 may be placed on a table with the curving flex plate 102 angling toward the user 128. This position provides a convenient and adjustable surface to place a book or electronic device. The foam covering 122 provides friction to hold the item such that it will not slip down curved flex plate 102. (2) As a secondary head rest, the body support bridge 100 may be placed between a seat 126 and a window wall at shoulder level. This position provides a comfortable surface to hold a pillow for sleeping.

During transport, the body support bridge 100 is light weight and folds flat. It easily may be slipped into a briefcase, backpack or carry-on or carried in its own case which may be slung over a user's 128 shoulder or on the outside of another carry-on. A case for the body support bridge 100 may be designed with an inside pocket to carry a tablet computer and outside pockets to carry travel documents such as boarding passes, passports, itineraries, etc.

Referring to FIG. 5A thru FIG. 5D, the Body Support Bridge 100 is a highly useful travel accessory that helps a user 128 relax and sleep comfortably while sitting for long journeys. The body support bridge 100 helps users 128 change positions while sitting in confined spaces for long periods of time facilitating good circulation and supportive sitting posture. It adjusts to various heights to meet the user's 128 preference. It may be used as a lumbar support, thigh support, foot support, and head support. It also may be used as an angled table stand for reading or viewing.

INDUSTRIAL APPLICABILITY

It is clear that the inventive Body Support Bridge 100 of this application has wide applicability to the travel industry, namely to provide a device in a folded flat configuration that may be expanded to at least three different heights and used for at least four different body areas enabling a user 128 to change positions and sit comfortably for extended periods of time.

It should be understood that various modifications within the scope of this invention can be made by one of ordinary skill in the art without departing from the spirit thereof and without undue experimentation. This invention is therefore to be defined as broadly as the prior art will permit, and in view of the specification if need be, including a full range of current and future equivalents thereof.

We claim:

1. A body support bridge consisting of:

a flex plate having a stiffener section and a flex section;

a front plate having a first end connected to the flex section of the flex plate and a second end;

a base plate having a first end connected to the second end of the front plate to form a junction and a second end connected to the stiffener section of the flex plate;

a hinge located at the junction of the base plate and the front plate;

a height adjustment plate having a first end extending from the hinge located at the junction of the base plate and the front plate and a second end; and three height adjustment tabs are located on the interior of the flex section of the flex plate, each said height adjustment tab extending across the entire width of the flex section and configured to receive the second end of the height adjustment plate, wherein the height adjustment tabs are configured to leave the flex section less rigid than the stiffener section, wherein the flex plate further comprises engineered thicknesses to flex at controlled amounts along the flex section, wherein the front plate is configured to extend at an oblique angle with respect to the base plate in a first configuration with the height adjustment plate positioned against one of the height adjustment tabs, and wherein the front plate is configured to lay flat alongside the base plate in a second configuration with the height adjustment plate positioned flat adjacent the base plate.

2. The body support bridge of claim 1, further comprising hinges to connect the flex plate, front plate, and base plate thereby forming a continuous loop.

3. The body support bridge of claim 2, wherein the hinges are polymeric textile hinges, molded hinge points, or a combination thereof.

4. The body support bridge of claim 1, further consisting of magnets formed into the flex plate and the base plate and configured such that the magnets align with each other when the body support bridge is in the closed position.

5. The body support bridge of claim 1, wherein the height adjustment plate is hinged at the intersection of the front plate and the base plate.

6. The body support bridge of claim 1, wherein the height adjustment plate is configured to engage the height adjustment tabs under compression thereby causing the flex plate to form an arc.

7. The body support bridge of claim 6, wherein the size of the arc is determined by which height adjustment tab the height adjustment plate is engaged.

8. The body support bridge of claim 1, wherein the exterior of the body support bridge is covered with foam.

9. The body support bridge of claim 8, wherein the foam is laminated onto the body support bridge or is removable.

10. The body support bridge of claim 9, wherein the foam is covered with a washable or disposable material.

11. The body support bridge of claim 1, wherein the flex plate is fitted with a rigid material in the stiffener section.

12. The body support bridge of claim 11, wherein the rigid material is wood or aluminum.

13. The body support bridge of claim 1, wherein the length of the flex plate equals the length of the base plate plus the length of the front plate thereby allowing the body support bridge to fold flat.

14. The body support bridge of claim 1, wherein the body support bridge is configured to provide lumbar support, thigh support, foot support, or a head support for a user.

15. The body support bridge of claim 1, wherein the body support bridge is configured to provide an angled table stand.

* * * * *